US012728316B2

(12) United States Patent
Chiu

(10) Patent No.: US 12,728,316 B2
(45) Date of Patent: Sep. 8, 2026

(54) ADAPTIVE STRENGTH TRAINING IN CABLE-MOTION FITNESS METHOD AND EQUIPMENT

(71) Applicant: INVENTEC APPLIANCES CORPORATION, New Taipei City (TW)

(72) Inventor: Ta-Chou Chiu, New Taipei City (TW)

(73) Assignee: INVENTEC APPLIANCES CORPORATION, New Taipei City (TW)

( * ) Notice: Subject to any disclaimer, the term of this patent is extended or adjusted under 35 U.S.C. 154(b) by 142 days.

(21) Appl. No.: 18/633,474

(22) Filed: Apr. 11, 2024

(65) Prior Publication Data

US 2025/0195952 A1 Jun. 19, 2025

(30) Foreign Application Priority Data

Dec. 15, 2023 (TW) ..... 112148946

(51) Int. Cl.
*A63B 24/00* (2006.01)
*A63B 21/00* (2006.01)
(Continued)

(52) U.S. Cl.
CPC ..... *A63B 24/0062* (2013.01); *A63B 21/0058* (2013.01); *A63B 21/153* (2013.01);
(Continued)

(58) Field of Classification Search
CPC ..... A63B 21/0058; A63B 21/0552; A63B 21/0724; A63B 21/153; A63B 24/0062; A63B 24/0087; A63B 2024/0093; A63B 2071/0627; A63B 2220/16; A63B 2220/24; A63B 2220/00; A63B 2220/50;
(Continued)

(56) References Cited

U.S. PATENT DOCUMENTS 6,280,361 B1 * 8/2001 Harvey ..... A63B 24/00 482/4
2018/0214729 A1 * 8/2018 Rubin ..... A63B 24/0087
(Continued)

*Primary Examiner* — Megan Anderson
*Assistant Examiner* — Jonathan A Dicuia
(74) *Attorney, Agent, or Firm* — Li & Cai Intellectual Property Office

(57) ABSTRACT

A cable-motion fitness equipment and a cable-motion fitness method thereof are provided. The cable-motion fitness equipment includes an exercise assembly, and a first damping module and a second damping module that are connected to the exercise assembly. The exercise assembly includes an angle sensor. The cable-motion fitness method includes: activating the exercise assembly, and the first and second damping modules, so that the first damping module is communicatively connected to the exercise assembly and the second damping module for forming a synchronous network; detecting, by the angle sensor, whether or not an offset angle of the exercise assembly when being operated by a user exceeds an angle threshold; and controlling, by the first damping module, a magnitude of a resistance provided by the second damping module when the offset angle exceeds the angle threshold, so as to adjust a resistance balance state of the exercise assembly.

8 Claims, 9 Drawing Sheets

(51) Int. Cl.
*A63B 21/005* (2006.01)
*A63B 71/06* (2006.01)

(52) U.S. Cl.
CPC ..... *A63B 2024/0093* (2013.01); *A63B 2071/0627* (2013.01); *A63B 2220/24* (2013.01); *A63B 2220/40* (2013.01); *A63B 2220/50* (2013.01); *A63B 2220/833* (2013.01)

(58) Field of Classification Search
CPC ..... A63B 2220/62; A63B 2220/805; A63B 2220/833; A63B 2225/20; A63B 2225/50
See application file for complete search history.

(56) References Cited

U.S. PATENT DOCUMENTS

| | | | | |
|---|---|---|---|---|
| 2019/0168098 | A1* | 6/2019 | Kinsella | F41J 5/04 |
| 2021/0101052 | A1 | 4/2021 | Gore | |
| 2022/0079452 | A1 | 3/2022 | Rao et al. | |
| 2022/0262480 | A1 | 8/2022 | Riley et al. | |
| 2024/0009522 | A1* | 1/2024 | Huber | A63B 21/156 |
| 2025/0041647 | A1* | 2/2025 | Mooney | A63B 21/15 |

* cited by examiner

ADAPTIVE STRENGTH TRAINING IN CABLE-MOTION FITNESS METHOD AND EQUIPMENT

CROSS-REFERENCE TO RELATED PATENT APPLICATION

This application claims the benefit of priority to Taiwan Patent Application No. 112148946, filed on Dec. 15, 2023. The entire content of the above identified application is incorporated herein by reference.

FIELD OF THE DISCLOSURE

The present disclosure relates to a cable-motion fitness equipment and a cable-motion fitness method thereof, and more particularly to a cable-motion fitness equipment that is capable of providing a resistance compensation mechanism and a cable-motion fitness method thereof.

BACKGROUND OF THE DISCLOSURE

In a home fitness equipment, a fitness damping module (otherwise referred to as a fitness pump) can be used to replace a weight plate for safety considerations. The fitness damping module can output a set torque to provide a resistance for pulling a rope, so as to allow a user to perform various exercises for building full-body muscles.

Generally, the home fitness equipment includes a plurality of damping modules. For example, when the user is performing barbell curls or barbell lifting, such workout is conducted by using a barbell in cooperation with two damping modules on two sides (the left and right sides) of the barbell. However, due to the extended response time of the damping modules upon detecting the user's pulling force, the actions of the two damping modules can become asynchronous. This asynchrony may lead to an imbalance in resistance between the two sides, ultimately detracting from the overall user experience.

SUMMARY OF THE DISCLOSURE

In response to the above-referenced technical inadequacy, the present disclosure provides a cable-motion fitness equipment and a cable-motion fitness method thereof.

In order to solve the above-mentioned problem, one of the technical aspects adopted by the present disclosure is to provide a cable-motion fitness equipment, which includes an exercise assembly, a first damping module, and a second damping module. The exercise assembly includes an angle sensor that is configured to sense an offset angle of the exercise assembly. The first damping module and the second damping module are connected to the exercise assembly. Each of the first damping module and the second damping module includes a resistance sensor, and the resistance sensor is configured to sense a resistance that is applied to the exercise assembly by each of the first damping module and the second damping module. The first damping module is communicatively connected to the exercise assembly and the second damping module for forming a synchronous network. When the angle sensor detects that the offset angle of the exercise assembly exceeds an angle threshold, the first damping module controls a magnitude of the resistance provided by the second damping module.

In order to solve the above-mentioned problem, another one of the technical aspects adopted by the present disclosure is to provide a cable-motion fitness method of a cable-motion fitness equipment. The cable-motion fitness equipment includes an exercise assembly, a first damping module, and a second damping module. The exercise assembly includes an angle sensor. The first damping module and the second damping module are connected to the exercise assembly. The cable-motion fitness method includes: activating the exercise assembly, the first damping module, and the second damping module, so that the first damping module is communicatively connected to the exercise assembly and the second damping module for forming a synchronous network; detecting, by the angle sensor, whether or not an offset angle of the exercise assembly when being operated by a user exceeds an angle threshold; and controlling, by the first damping module, a magnitude of a resistance provided by the second damping module when the offset angle exceeds the angle threshold, so as to adjust a resistance balance state of the exercise assembly.

Therefore, in the cable-motion fitness equipment and the cable-motion fitness method thereof provided by the present disclosure, the synchronous network can be formed through the first damping module being communicatively connected to the exercise assembly and the second damping module. As such, when resistances of two sides of the exercise assembly are so unbalanced as to cause the offset angle to be too large, the first damping module can control the magnitude of the resistance to adjust the resistance balance state of the exercise assembly.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
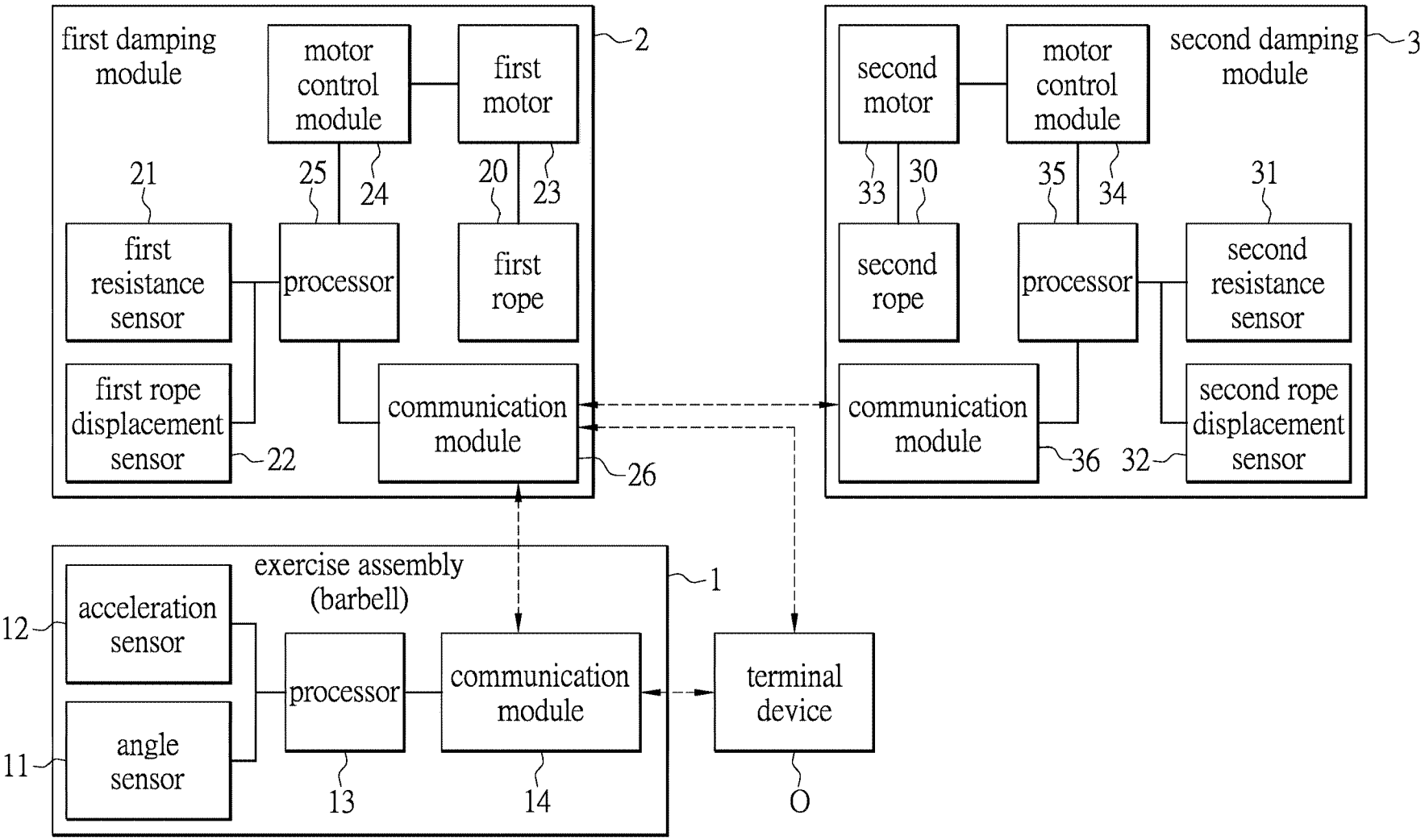
FIG. 1 is a schematic system diagram of a cable-motion fitness equipment according to one embodiment of the present disclosure.
Figure 2:
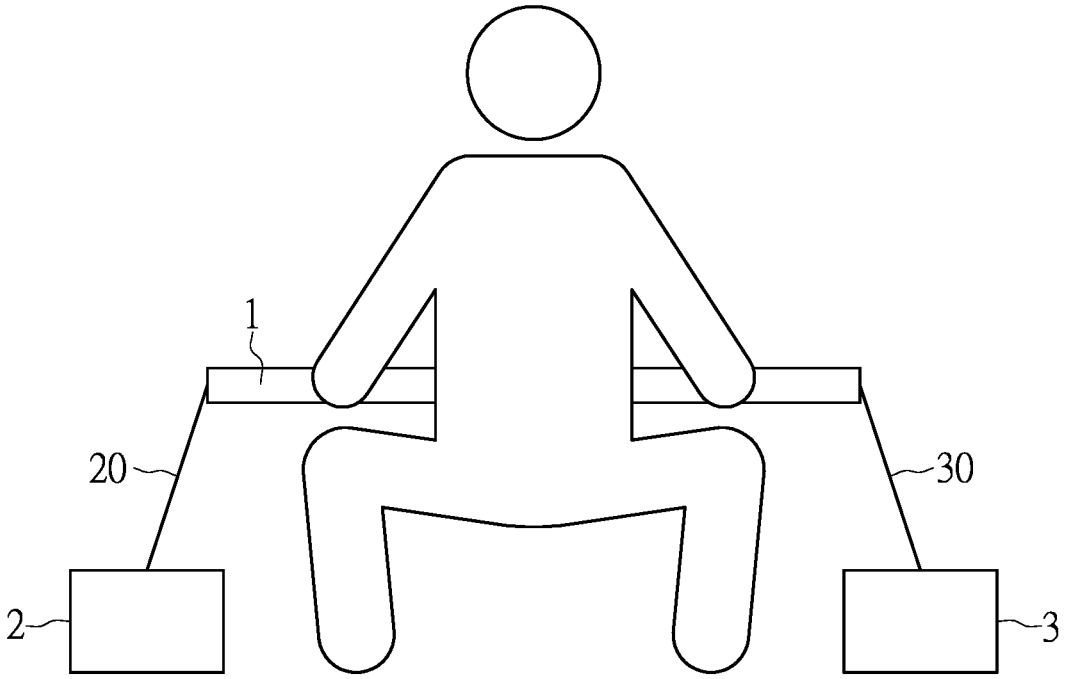
FIG. 2 is a schematic view showing a user operating the cable-motion fitness equipment according to one embodiment of the present disclosure.
Figure 3:
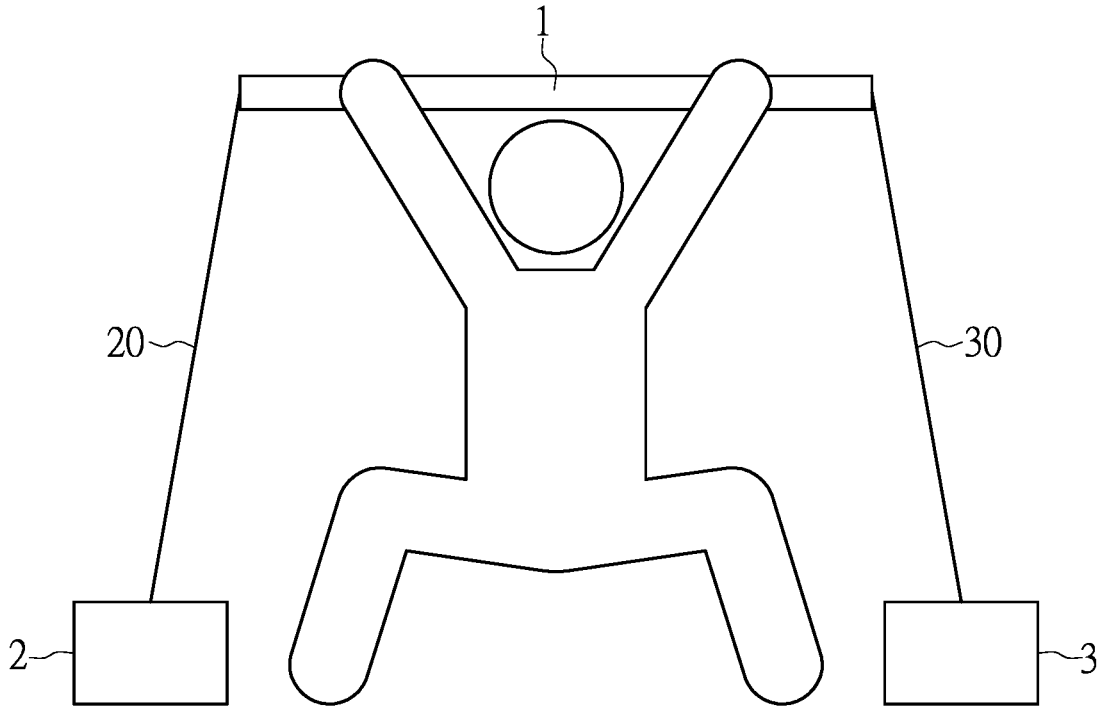
FIG. 3 is another schematic view showing the user operating the cable-motion fitness equipment according to one embodiment of the present disclosure.

Referring to FIG. 1 to FIG. 3, an embodiment of the present disclosure provides a cable-motion fitness equipment, which includes an exercise assembly 1, a first damping module 2, and a second damping module 3. The first damping module 2 and the second damping module 3 are connected to the exercise assembly 1. In the embodiment of the present disclosure, the exercise assembly 1 is exemplified as a bar, but is not limited thereto. The first damping module 2 and the second damping module 3 are resistance pumps, which can provide resistances when a user operates the exercise assembly 1 during a workout. It should be noted that, the cable-motion fitness equipment of the present embodiment includes at least two damping modules, but a specific quantity of the damping modules is not limited thereto.

The exercise assembly 1 includes an angle sensor 11, the first damping module 2 includes a first resistance sensor 21, and the second damping module 3 includes a second resistance sensor 31. For example, the angle sensor 11 can be a gyroscope, and the first resistance sensor 21 and the second resistance sensor 31 can each be a force sensor.

When the user performs a lifting action or a squatting action, the first damping module 2 and the second damping module 3 each applies the resistance to the exercise assembly 1. At this time, the angle sensor 11 senses an offset angle of the exercise assembly 1, the first resistance sensor 21 senses the resistance applied to the exercise assembly 1 by the first damping module 2, and the second resistance sensor 31 senses the resistance applied to the exercise assembly 1 by the second damping module 3.

The exercise assembly 1 further includes an acceleration sensor 12 and a processor 13. The angle sensor 11 and the acceleration sensor 12 are electrically connected to the processor 13. The acceleration sensor 12 is mainly configured to sense a moving speed of the exercise assembly 1. The first damping module 2 further includes a first rope 20, a first rope displacement sensor 22, a first motor 23, a motor control module 24, and a processor 25. The first resistance sensor 21, the first rope displacement sensor 22, and the motor control module 24 are electrically connected to the processor 25, and the processor 25 controls the first motor 23 via the motor control module 24. The first rope 20 is connected to the exercise assembly 1 and the first motor 23. The first motor 23 is configured to output the resistance and control an extended length of the first rope 20, and the first rope displacement sensor 22 is configured to sense the extended length of the first rope 20. Similarly, the second damping module 3 further includes a second rope 30, a second rope displacement sensor 32, a second motor 33, a motor control module 34, and a processor 35. The second resistance sensor 31, the second rope displacement sensor 32, and the motor control module 34 are electrically connected to the processor 35, and the processor 35 controls the second motor 33 via the motor control module 34. The second rope 30 is connected to the exercise assembly 1 and the second motor 33. The second motor 33 is configured to output the resistance and control an extended length of the second rope 30, and the second rope displacement sensor 32 is configured to sense the extended length of the second rope 30. In addition, each of the first rope displacement sensor 22 and the second rope displacement sensor 32 can be, for example, a displacement sensor. Each of the processors 25, 35 can be a microcontroller unit (MCU).

Each of the exercise assembly 1, the first damping module 2, and the second damping module 3 further includes a communication module. The first damping module 2, the exercise assembly 1, and the second damping module 3 are communicatively connected to each other via their respective communication modules. Through its communication module 26, the first damping module 2 can be communicatively connected to a communication module 14 of the exercise assembly 1 and a communication module 36 of the second damping module 3, so as to jointly form a synchronous network. The formation of the synchronous network allows the first resistance sensor 21 and the second resistance sensor 31 to be able to transmit messages with each other and operate synchronously. For example, the communication modules 14, 26, 36 can each be a communication module that simultaneously supports communication methods such as BLUETOOTH® and ZigBee. However, the present disclosure is not limited thereto.

The user can uniformly control operations of all the damping modules in the synchronous network and obtain output values. Hence, the user can use a terminal device O to input and set the desired resistance intensity for the workout into the first damping module 2, and then the first damping module 2 transmits the set resistance intensity to the second damping module 3. In this way, the processor 25 of the first damping module 2 adjusts the resistance output by the first motor 23 to reach a set value via the motor control module 24, and the processor 35 of the second damping module 3 adjusts the resistance output by the second motor 33 to reach the set value via the motor control module 34.

Figure 4:
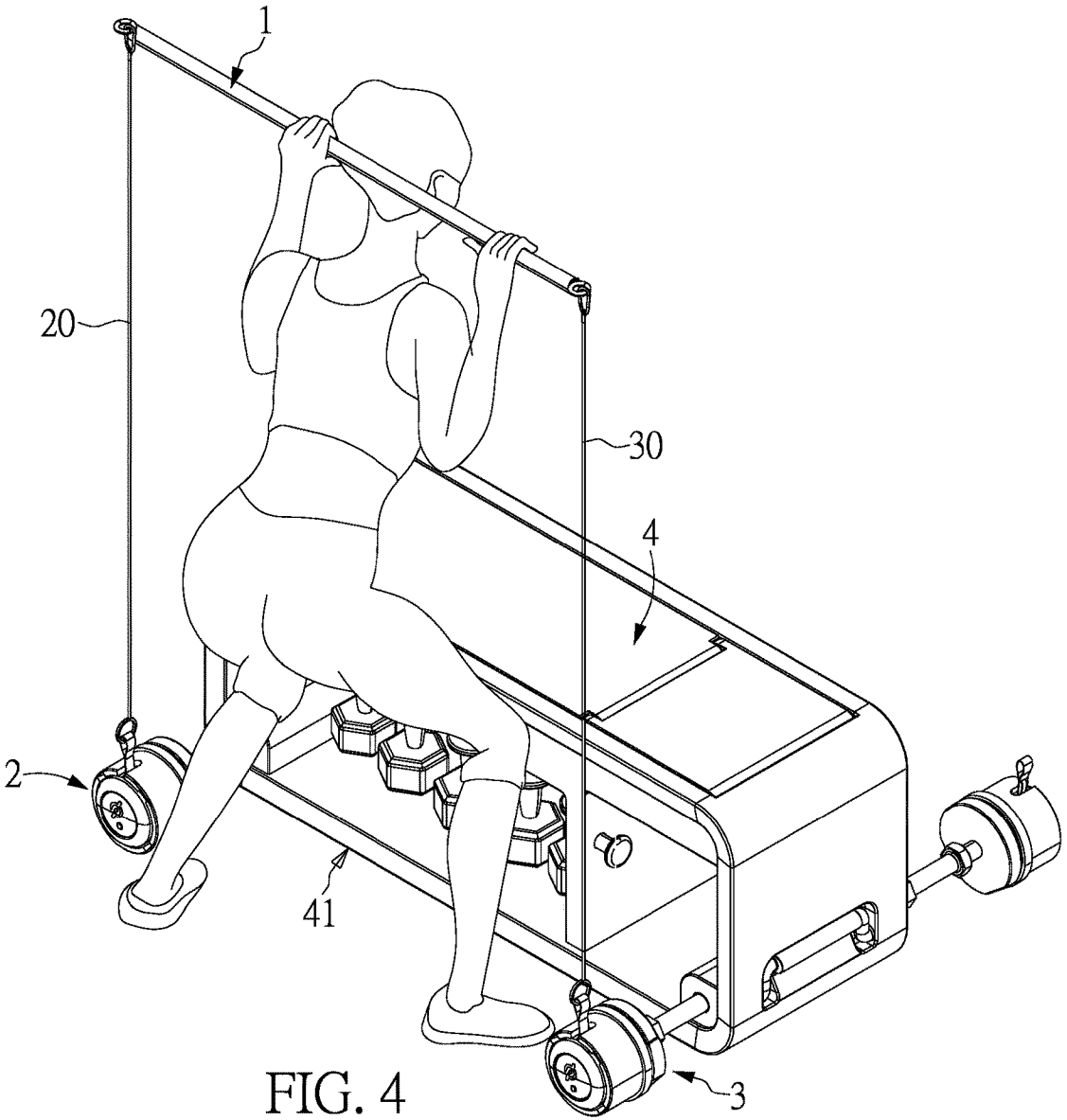
FIG. 4 is a schematic view of the cable-motion fitness equipment according to another embodiment of the present disclosure.

Referring to FIG. 4, the cable-motion fitness equipment provided by the present disclosure can be a training bench 4 that combines the above-mentioned exercise assembly 1 and the damping modules. The damping modules are appropriately disposed at a periphery of the training bench 4. The user can use the training bench 4 for combination of the exercise assembly 1 and the damping modules, and perform different exercises. Specifically, in FIG. 4, the first damping module 2 and the second damping module 3 are disposed on a same long side 41 of the training bench 4, and the user stands between the first damping module 2 and the second damping module 3 to perform the overhead press or the squat.

Figure 5:
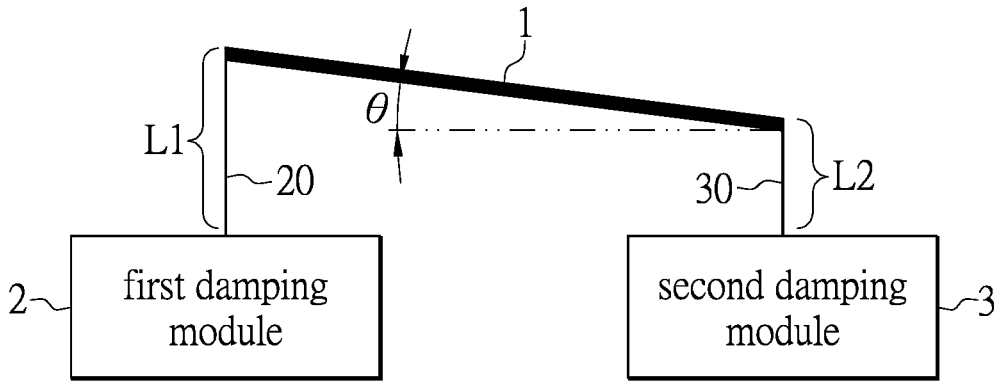
FIG. 5 is a schematic view showing use of the cable-motion fitness equipment in a resistance unbalanced state according to one embodiment of the present disclosure.
Figure 6:
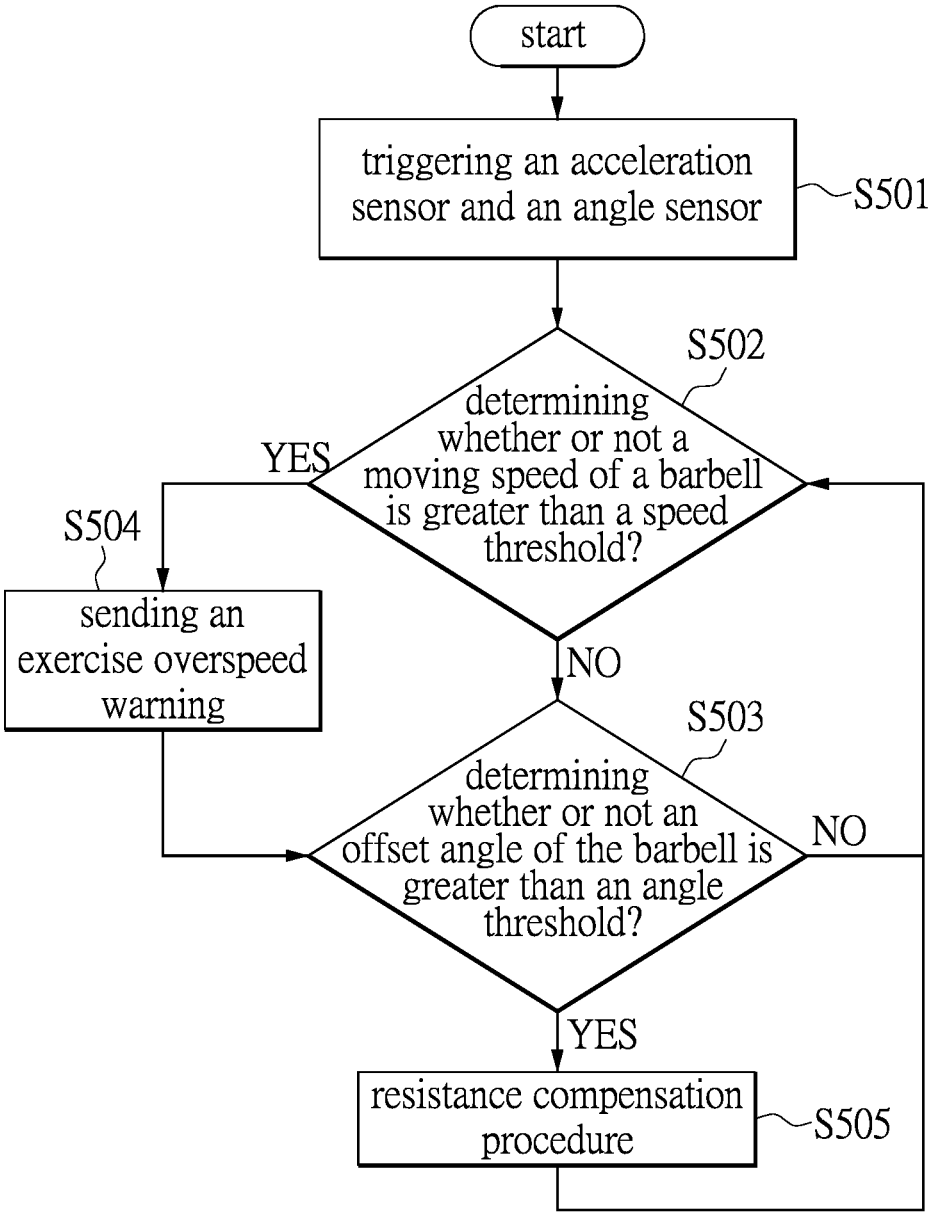
FIG. 6 is a flowchart of a cable-motion fitness method of the cable-motion fitness equipment according to one embodiment of the present disclosure.

Reference is made to FIG. 6. In step S501, the angle sensor 11 and the acceleration sensor 12 are triggered when the user begins the workout (e.g., the lifting action shown in FIG. 2 and FIG. 3), so as to respectively detect the offset angle and the moving speed of the exercise assembly 1 when being operated by the user and transmit the detected offset angle and the detected moving speed to the processor 13. In step S502 and step S503, the processor 13 determines whether or not the moving speed of the exercise assembly 1 exceeds a speed threshold, and determines whether or not an offset angle Θ (as shown in FIG. 5) of the exercise assembly 1 is greater than an angle threshold. When the moving speed exceeds the speed threshold, step S502 is followed by step S504, and a warning message is sent out by a warning unit (not shown) disposed on the exercise assembly 1 to remind the user that his/her exercise speed is too fast. For example, the warning unit can be a miniaturized display screen, a speaker, or a light-emitting diode (LED), and the warning message can be a text, an icon, a sound, or light that corresponds thereto. When the offset angle Θ exceeds the angle threshold (as shown in FIG. 5), step S503 is followed by step S505, and a resistance compensation procedure is triggered.

Figure 7:
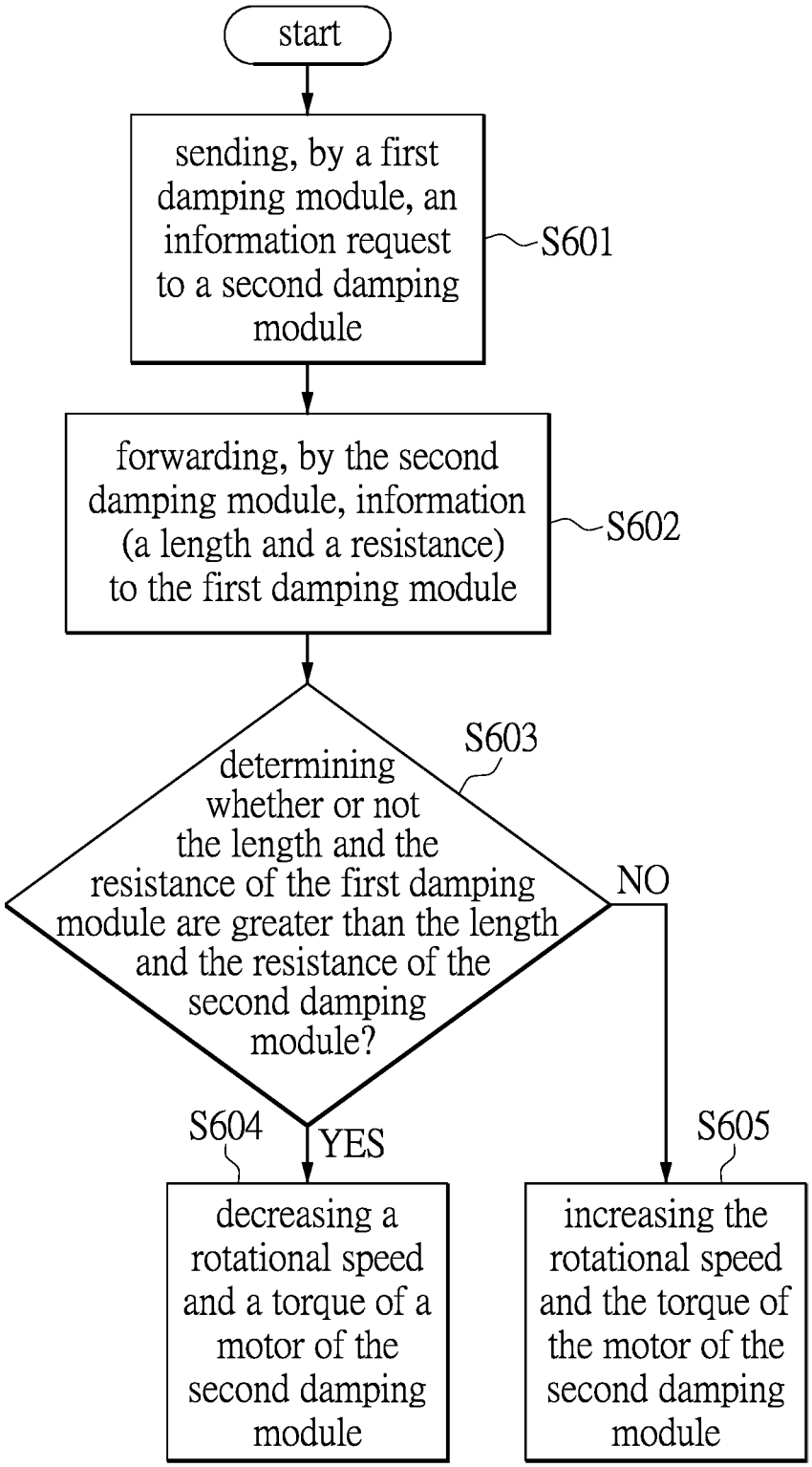
FIG. 7 is a flowchart of a resistance compensation procedure in the cable-motion fitness method of the cable-motion fitness equipment according to one embodiment of the present disclosure.

Referring to FIG. 7, the resistance compensation procedure is further illustrated. When the processor 13 of the exercise assembly 1 determines that the offset angle Θ is greater than the angle threshold and the resistance compensation procedure is triggered, the processor 13 notifies the first damping module 2 that acts as a coordinator in step S601 and step S602. The first damping module 2 sends an information request to the second damping module 3, and requests the second damping module 3 to provide information that includes a current resistance output by the second motor 33 and an extended length L2 of the second rope 30. After receiving the information request, the second damping module 3 forwards the information to the first damping module 2.

In step S603 to step S605, the processor 25 of the first damping module 2 compares a current resistance output by the first motor 23 and an extended length L1 of the first rope 20 with the information forwarded by the second damping module 3, so as to determine whether or not the current resistance output by the first motor 23 is greater than the current resistance output by the second motor 33, and whether or not the extended length L1 of the first rope 20 is greater than the extended length L2 of the second rope 30. If yes, the processor 25 of the first damping module 2 sends an adjustment request to the processor 35 of the second damping module 3, and the processor 35 controls the second motor 33 to decrease a rotational speed and a torque via the motor control module 34, so as to increase the resistance output by the second motor 33. If not, the processor 25 of the first damping module 2 sends another adjustment request to the processor 35 of the second damping module 3, and the processor 35 controls the second motor 33 to increase the rotational speed and the torque via the motor control module 34, so as to decrease the resistance output by the second motor 33. In this way, the resistances received by two sides (the left and right sides) of a barbell can reach a balanced state.

At certain locations (e.g., a gym), multiple exercise assemblies and multiple damping modules can be provided and used by numerous users. Therefore, in the embodiment below, a whitelist is pre-established, and the exercise assembly and the damping modules on the same whitelist are configured to form the synchronous network, so as to prevent the occurrence of mutual interference when different users activate multiple pieces of the cable-motion fitness equipment.

Figure 8:
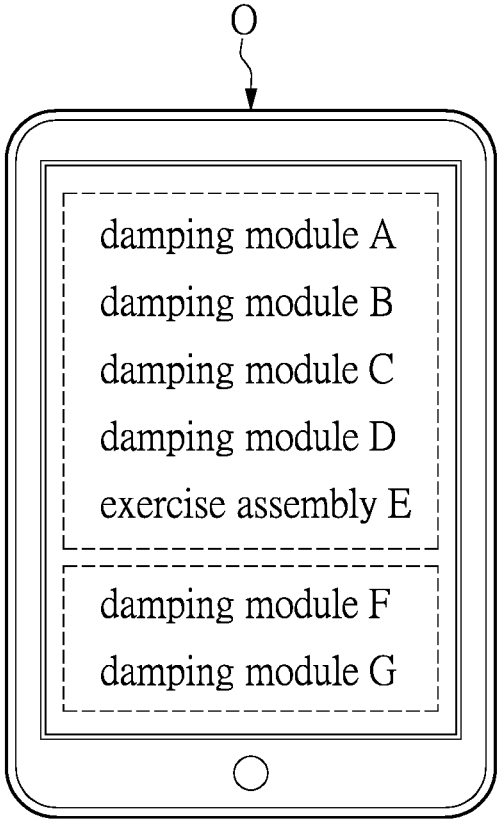
FIG. 8 is a schematic view of a user terminal device.

Before the user activates the cable-motion fitness equipment, the whitelist can be pre-established, and the multiple damping modules and the exercise assembly are listed on the whitelist. The user can add the exercise assembly and the damping modules to the whitelist by mobile barcode scanning or other short-range communication methods (e.g., near-field communication (NFC) or radio-frequency identification (RFID)). One whitelist can include more than one damping module and the exercise assembly. As shown in FIG. 8, the user can use the terminal device O to check the whitelist on which each exercise assembly and the damping modules are listed. While damping modules A to D and an exercise assembly E belong to the same whitelist, a damping module F and a damping module G belong to another whitelist. By pre-establishing the whitelist, all the damping modules disposed on the same training bench of FIG. 4 can be established on the same whitelist by the user.

Figure 9:
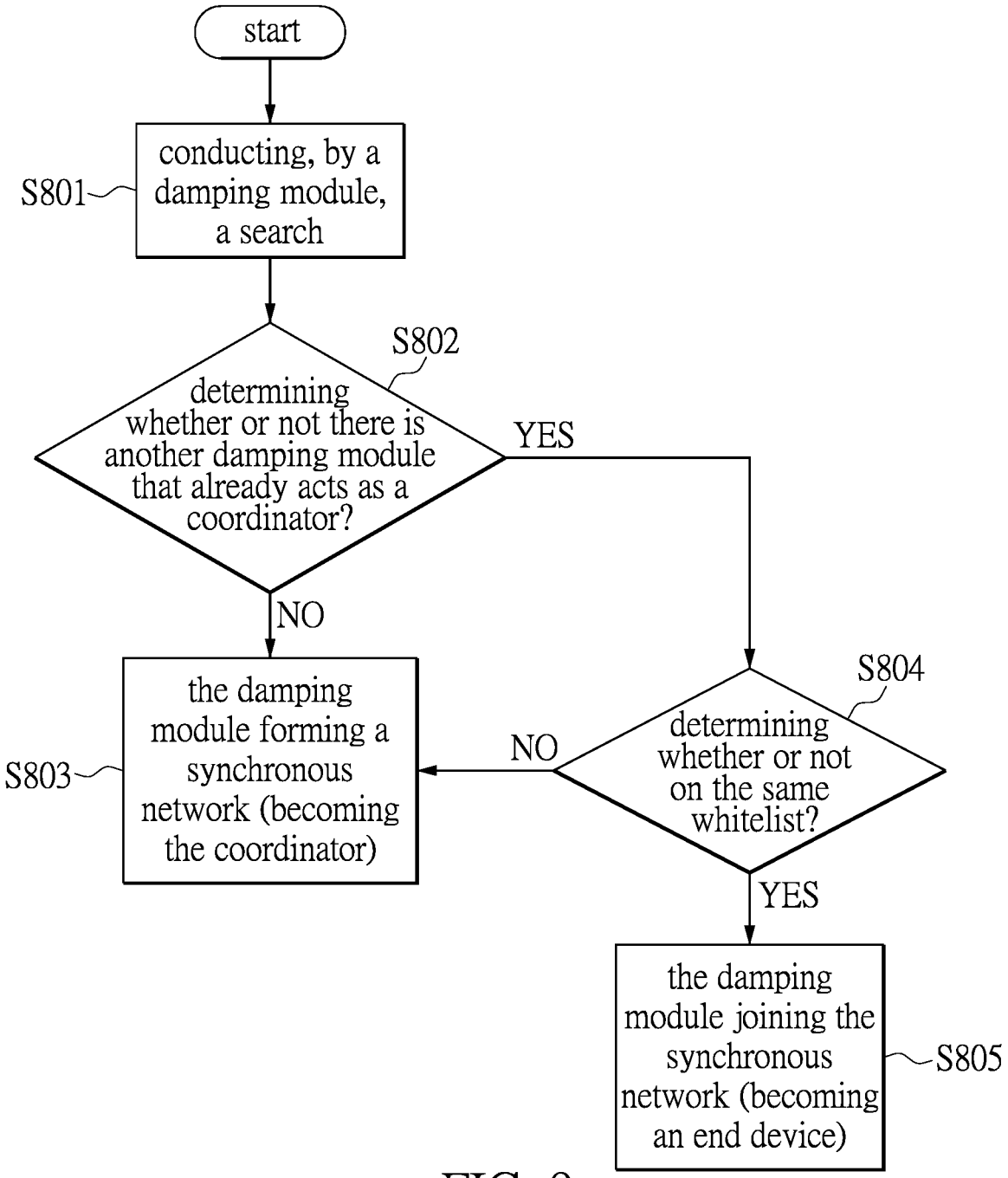
FIG. 9 is a flowchart of a procedure for forming a synchronous network in the cable-motion fitness method of the cable-motion fitness equipment according to one embodiment of the present disclosure.

Referring to FIG. 9, a flowchart of a procedure for forming the synchronous network is shown. After the user activates one of the damping modules, step S801 and step S802 are performed. In step S801 and step S802, the damping module conducts a search via its internal communication module, and determines whether or not there is another one of the damping modules that already acts as the coordinator in a surrounding environment.

When the damping module determines that another one of the damping modules that has already become the coordinator is not detected, step S802 is followed by step S803. In step S803, the damping module automatically becomes the coordinator, and allows other ones of the damping modules that are on the whitelist and activated at a later time to be automatically and communicatively connected thereto, so as to jointly form the synchronous network. When the damping module determines that another one of the damping modules that has already become the coordinator is detected, step S802 is followed by step S804. In step S804, whether or not another one of the damping modules that has already become the coordinator is on the same whitelist is further determined. If not, step S804 proceeds to step S803. If yes, step S804 is followed by step S805. In step S805, the damping module becomes an end device, and is automatically and communicatively connected to another one of the damping modules that has already become the coordinator, so as to form the synchronous network. It should be noted that the quantity of the damping modules in the synchronous network is not limited. The damping module that is firstly activated becomes the coordinator, and other ones of the damping modules that are subsequently activated become the end devices. The coordinator is configured to establish a network and distribute network addresses, and the end device can only join the network that is already formed.

Taking the damping module A in FIG. 8 for example, if the damping module A is activated and detects the damping module B on the same whitelist, the damping module A becomes the end device, and is automatically and communicatively connected to the damping module B that has already become the coordinator, so that the damping module A and the damping module B establish the synchronous network. After activation of the damping module A, if no damping module on the same whitelist is detected, or only the damping module F or the damping module G that is not on the same whitelist is detected, the damping module A automatically becomes the coordinator. In this way, when the user uses the damping module A, there is no need to worry that the damping module A may mistakenly form the synchronous network with the damping module F used by another person (on another whitelist).

Furthermore, when the user activates the exercise assembly, the exercise assembly similarly searches the surrounding environment for the damping module that has already become the coordinator via its internal communication module. Taking the exercise assembly E in FIG. 8 for example, if the damping module A that is on the same whitelist and has already become the coordinator is detected in the surrounding environment, the exercise assembly E is automatically and communicatively connected to the damping module A for joining the synchronous network. If no damping module on the same whitelist is detected, or only the damping module F or the damping module G that is not on the same whitelist is detected, the exercise assembly E will not join the synchronous network.

In conclusion, in the cable-motion fitness equipment and the cable-motion fitness method thereof provided by the present disclosure, through establishing the synchronous network formed by the damping modules and the barbell, the multiple damping modules can operate synchronously. When the barbell detects a resistance imbalance, the barbell can automatically compensate an output of the damping module. In this way, the user can be prevented from feeling the imbalance between the resistances of the two sides when operating the cable-motion fitness equipment.

What is claimed is:

1. A cable-motion fitness equipment, comprising:

an exercise assembly, wherein the exercise assembly includes an angle sensor that is configured to sense an offset angle of the exercise assembly; and a first damping module and a second damping module connected to the exercise assembly, wherein each of the first damping module and the second damping module includes a resistance sensor, and the resistance sensor is configured to sense a resistance that is applied to the exercise assembly by each of the first damping module and the second damping module;

wherein the first damping module is communicatively connected to the exercise assembly and the second damping module for forming a synchronous network; wherein, when the angle sensor detects that the offset angle of the exercise assembly exceeds an angle threshold, the first damping module controls a magnitude of the resistance provided by the second damping module;

wherein a procedure for forming the synchronous network includes:

establishing a whitelist, wherein a plurality of damping modules and the exercise assembly are listed on the whitelist; and activating one of the damping modules to search a surrounding environment for another one of the damping modules that is on the whitelist and already activated;

wherein, in response to not detecting the another one of the damping modules, the one of the damping modules becomes a coordinator, and is communicatively connected to other ones of the damping modules that are on the whitelist and activated at a later time, so as to jointly form the synchronous network;

wherein, in response to detecting the another one of the damping modules, the one of the damping modules becomes an end device, and is communicatively connected to the another one of the damping modules that is already activated, so as to jointly form the synchronous network;

wherein the damping module that acts as the coordinator is the first damping module, and the damping module that acts as the end device is the second damping module.

2. The cable-motion fitness equipment according to claim 1, wherein the exercise assembly further includes an acceleration sensor; wherein, when the acceleration sensor detects that a moving speed of the exercise assembly exceeds a speed threshold, the exercise assembly sends a warning message.

3. The cable-motion fitness equipment according to claim 1, wherein the procedure for forming the synchronous network further includes:

activating the exercise assembly to search the surrounding environment for the first damping module on the whitelist;

wherein, in response to detecting the first damping module, the exercise assembly is communicatively connected to the first damping module for joining the synchronous network.

4. The cable-motion fitness equipment according to claim 1, wherein each of the first damping module and the second damping module further includes a rope, a motor, and a rope displacement sensor, the rope is connected to the exercise assembly and the motor, the motor is configured to output the resistance and control an extended length of the rope, and the rope displacement sensor is configured to sense the extended length of the rope;

wherein each of the exercise assembly, the first damping module, and the second damping module further includes a communication module, and the first damping module, the exercise assembly, and the second damping module are communicatively connected to each other via the respective communication module;

wherein the process of the first damping module controlling the magnitude of the resistance provided by the second damping module includes:

sending, by the first damping module, an information request to the second damping module, so that the second damping module provides information that includes a current resistance output by the second damping module and the extended length of the rope of the second damping module;

forwarding, by the second damping module, the information to the first damping module; and comparing, by the first damping module, a current resistance output by the first damping module and the extended length of the rope of the first damping module with the information forwarded by the second damping module, so as to determine whether or not the current resistance output by the first damping module is greater than the current resistance output by the second damping module, and whether or not the extended length of the rope of the first damping module is greater than the extended length of the rope of the second damping module;

wherein, in response to determining that the current resistance output by the first damping module is greater than the current resistance output by the second damping module, and that the extended length of the rope of the first damping module is greater than the extended length of the rope of the second damping module, the first damping module sends an adjustment request to the second damping module, so that the second damping module decreases a rotational speed and a torque of the motor of the second damping module;

wherein, in response to determining that the current resistance output by the first damping module is not greater than the current resistance output by the second damping module, and that the extended length of the rope of the first damping module is not greater than the extended length of the rope of the second damping module, the first damping module sends another adjustment request to the second damping module, so that the second damping module increases the rotational speed and the torque of the motor of the second damping module.

5. A cable-motion fitness method of a cable-motion fitness equipment, wherein the cable-motion fitness equipment includes an exercise assembly, a first damping module, and a second damping module, the exercise assembly includes an angle sensor, and the first damping module and the second damping module are connected to the exercise assembly, the cable-motion fitness method comprising:

activating the exercise assembly, the first damping module, and the second damping module, so that the first damping module is communicatively connected to the exercise assembly and the second damping module for forming a synchronous network;

detecting, by the angle sensor, whether or not an offset angle of the exercise assembly when being operated by a user exceeds an angle threshold; and controlling, by the first damping module, a magnitude of a resistance provided by the second damping module when the offset angle exceeds the angle threshold, so as to adjust a resistance balance state of the exercise assembly;

wherein a procedure for forming the synchronous network includes:

establishing a whitelist, wherein a plurality of damping modules and the exercise assembly are listed on the whitelist; and activating one of the damping modules to search a surrounding environment for another one of the damping modules that is on the whitelist and already activated;

wherein, in response to not detecting the another one of the damping modules, the one of the damping modules becomes a coordinator, and is communicatively connected to other ones of the damping modules that are on the whitelist and activated at a later time, so as to jointly form the synchronous network;

wherein, in response to detecting the another one of the damping modules, the one of the damping modules becomes an end device, and is communicatively connected to the another one of the damping modules that is already activated, so as to jointly form the synchronous network;

wherein the damping module that acts as the coordinator is the first damping module, and the damping module that acts as the end device is the second damping module.

6. The cable-motion fitness method according to claim 5, wherein the procedure for forming the synchronous network further includes:

activating the exercise assembly to search the surrounding environment for the first damping module on the whitelist; and establishing, in response to detecting the first damping module on the whitelist in the surrounding environment of the exercise assembly, a communicative connection between the exercise assembly and the first damping module, so as to join the synchronous network.

7. The cable-motion fitness method according to claim 6, wherein each of the first damping module and the second damping module further includes a rope, a motor, and a rope displacement sensor, the rope is connected to the exercise assembly and the motor, the motor is configured to output the resistance and control an extended length of the rope, and the rope displacement sensor is configured to sense the extended length of the rope;

wherein each of the exercise assembly, the first damping module, and the second damping module further includes a communication module, and the first damping module, the exercise assembly, and the second damping module are communicatively connected to each other via the respective communication module;

wherein the process of the first damping module controlling the magnitude of the resistance provided by the second damping module includes:

sending, by the first damping module, an information request to the second damping module, so that the second damping module provides information that includes a current resistance output by the second damping module and the extended length of the rope of the second damping module;

forwarding, by the second damping module, the information to the first damping module; and comparing, by the first damping module, a current resistance output by the first damping module and the extended length of the rope of the first damping module with the information forwarded by the second damping module, so as to determine whether or not the current resistance output by the first damping module is greater than the current resistance output by the second damping module, and whether or not the extended length of the rope of the first damping module is greater than the extended length of the rope of the second damping module;

wherein, in response to determining that the current resistance output by the first damping module is greater than the current resistance output by the second damping module, and that the extended length of the rope of the first damping module is greater than the extended length of the rope of the second damping module, the first damping module sends an adjustment request to the second damping module, so that the second damping module decreases a rotational speed and a torque of the motor of the second damping module;

wherein, in response to determining that the current resistance output by the first damping module is not greater than the current resistance output by the second damping module, and that the extended length of the rope of the first damping module is not greater than the extended length of the rope of the second damping module, the first damping module sends another adjustment request to the second damping module, so that the second damping module increases the rotational speed and the torque of the motor of the second damping module.

8. The cable-motion fitness method according to claim 7, wherein, before the process of using the angle sensor to detect the offset angle of the exercise assembly when being operated by the user, the cable-motion fitness method further includes:

detecting, by an acceleration sensor of the exercise assembly, a moving speed of the exercise assembly when being operated by the user, and determining whether or not the moving speed exceeds a speed threshold; and sending, by the exercise assembly, a warning message to remind the user when the moving speed exceeds the speed threshold.

* * * * *